US011765514B2

(12) United States Patent
Yang

(10) Patent No.: US 11,765,514 B2
(45) Date of Patent: Sep. 19, 2023

(54) SPEAKER

(71) Applicant: AAC Microtech (Changzhou) Co., Ltd., Changzhou (CN)

(72) Inventor: Huhu Yang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/560,264

(22) Filed: Dec. 23, 2021

(65) Prior Publication Data

US 2023/0086434 A1 Mar. 23, 2023

(30) Foreign Application Priority Data

Sep. 22, 2021 (CN) ..... 202122300139.6

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01)

(58) Field of Classification Search
CPC ..... H04R 9/025; H04R 7/18; H04R 2400/11
See application file for complete search history.

(56) References Cited

U.S. PATENT DOCUMENTS

| | | | | |
|---|---|---|---|---|
| 10,341,779 | B2 * | 7/2019 | Li | H04R 7/18 |
| 2018/0302724 | A1 * | 10/2018 | Li | H04R 1/06 |
| 2020/0045457 | A1 * | 2/2020 | Linghu | H04R 1/021 |
| 2020/0045466 | A1 * | 2/2020 | Song | H04R 9/043 |
| 2020/0053478 | A1 * | 2/2020 | Liu | H04R 7/18 |
| 2020/0213752 | A1 * | 7/2020 | Xiao | H04R 7/12 |
| 2020/0213761 | A1 * | 7/2020 | Xiao | H04R 7/04 |

FOREIGN PATENT DOCUMENTS

| | | | | |
|---|---|---|---|---|
| CN | 202455530 U | * | 9/2012 | |
| CN | 209693041 U | * | 11/2019 | |
| CN | 211531289 U | * | 9/2020 | |
| CN | 211860530 U | * | 11/2020 | H04R 9/025 |

* cited by examiner

*Primary Examiner* — Angelica M McKinney
(74) *Attorney, Agent, or Firm* — W&G Law Group

(57) ABSTRACT

Provided is a speaker, including a frame, a vibration unit fixed to the frame, and a magnetic circuit unit including a magnetic gap. The magnetic circuit unit includes a yoke, and a magnet; the vibration unit includes a diaphragm, and a voice coil; the voice coil is inserted into the magnetic gap to drive the diaphragm to vibrate and produce sound; the speaker further includes a conductive lower diaphragm; the conductive lower diaphragm includes an inner connecting portion, an outer connecting portion, and an intermediate portion; the voice coil is electrically connected to the inner connecting portion; and the outer connecting portion is electrically connected to an external circuit. With this structure, internal space of the speaker is saved, reducing material cost and improving reliability.

7 Claims, 4 Drawing Sheets

A-A

33

SPEAKER

TECHNICAL FIELD

The present disclosure relates to the technical field of electronic elements, in particular to a speaker.

BACKGROUND

A speaker typically includes a magnetic circuit unit composed of a yoke, a magnet and a pole plate, and a vibration unit composed of a diaphragm, a voice coil and a holder. In order to improve the stability of the vibration unit, a lower diaphragm is usually fixed to a lower end of the voice coil to support the voice coil. Besides, a flexible printed circuit (FPC) is usually provided between the lower end of the voice coil and the lower diaphragm to electrically connect the voice coil to an external circuit. An inner side of the FPC is electrically connected to the voice coil, and an outer side of the FPC is electrically connected to the external circuit. An elastic arm between the inner side and the outer side of the FPC provides an elastic force for elastic vibration.

However, the FPC requires a large internal space of the speaker. A short arm length of the FPC will cause low reliability and fracture of the FPC, and an insufficient internal space of the speaker will result in an interference between the FPC and the lower diaphragm.

To solve the above problem, it needs to provide a speaker with a conductive lower diaphragm.

SUMMARY

An objective of the present disclosure is to provide a speaker with a conductive lower diaphragm.

An embodiment of the present disclosure provides a speaker, including a frame, a vibration unit fixed to the frame, and a magnetic circuit unit including a magnetic gap, wherein the magnetic circuit unit includes a yoke fixed to the frame, and a magnet fixed to a side of the yoke facing the vibration unit; the vibration unit includes a diaphragm fixed to the frame, and a voice coil fixed to the diaphragm; the voice coil is inserted into the magnetic gap to drive the diaphragm to vibrate and produce sound; the speaker further includes at least one conductive lower diaphragm fixed to the voice coil and opposite to and spaced apart from the diaphragm; each of the at least one conductive lower diaphragm includes an inner connecting portion fixed to and connected to the voice coil, an outer connecting portion fixed to and connected to the frame, and an intermediate portion configured to connect the inner connecting portion and the outer connecting portion; the voice coil is electrically connected to the inner connecting portion; and the outer connecting portion is electrically connected to an external circuit.

As an improvement, the voice coil has a racetrack shape; the at least one conductive lower diaphragm includes four conductive lower diaphragms; and the four inner connecting portions of the four conductive lower diaphragms are connected to corners of the voice coil, respectively.

As an improvement, the vibration unit further includes a holder for supporting the voice coil inside the magnetic gap; the holder includes a body portion having a ring shape and sandwiched between the voice coil and the diaphragm, a first extension portion extending along an outer side surface of the voice coil after bending from the body portion in a direction away from the diaphragm, and a second extension portion extending from an end of the first extension portion away from the body portion in a direction away from the outer side surface of the voice coil; and the inner connecting portion is fixed to the second extension portion.

As an improvement, the magnet includes a main magnet located at a central position, and auxiliary magnets that are spaced apart from each other at a peripheral side of the main magnet and spaced apart from the main magnet to form the magnetic gap; the auxiliary magnets include first auxiliary magnets arranged along long edges of the voice coil and second auxiliary magnets arranged along short edges of the voice coil; the first auxiliary magnets are spaced apart from the second auxiliary magnets to form accommodating gaps; and the at least one conductive lower diaphragm is accommodated in the accommodating gaps.

As an improvement, the first extension portion is spaced apart from the outer side surface of the voice coil.

As an improvement, the second extension portion is fixed to a surface of the inner connecting portion facing the diaphragm; and the inner connecting portion is opposite to and spaced apart from the voice coil.

As an improvement, the magnet includes a main magnet located at a central position, and auxiliary magnets that are spaced apart from each other at a peripheral side of the main magnet and spaced apart from the main magnet to form the magnetic gap; and the magnetic circuit unit further includes a main pole plate fixed to a surface of the main magnet facing the diaphragm, and an auxiliary pole plate fixed to a surface of each of the auxiliary magnets facing the diaphragm.

Compared with the related art, the speaker provided by the embodiments of the present disclosure includes a conductive lower diaphragm fixed to the voice coil and opposite to and spaced apart from the diaphragm. The conductive lower diaphragm includes an inner connecting portion fixed to and connected to the voice coil, an outer connecting portion fixed to and connected to the frame, and an intermediate portion connecting the inner connecting portion and the outer connecting portion. The voice coil is electrically connected to the inner connecting portion, and the outer connecting portion is electrically connected to an external circuit, thereby achieving electrical connection between the voice coil and the external circuit. Such a structure ensures the electrical connection between the voice coil and the external circuit, and eliminates the need for a flexible printed circuit (FPC) to save an internal space of the speaker and reduce the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

DETAILED DESCRIPTION OF EMBODIMENTS

In order to make the objectives, technical solutions and the advantages of the present disclosure clearer, the present disclosure is described in further detail below with reference to the drawings and embodiments. Understandably, the described embodiments are merely intended to explain the present disclosure, rather than to limit the present disclosure. All other embodiments obtained by those of ordinary skill in the art based on the embodiments in the present disclosure without creative efforts should fall within the protection scope of the present disclosure.

Terms such as "first", "second", "third" and "fourth" (if any) in the specification, claims and drawings of the present disclosure are intended to distinguish between similar objects, rather than to necessarily indicate a specific order or sequence. It should be understood that these terms such as "first", "second", "third" and "fourth" may be exchanged under proper conditions to make it possible for the described embodiments of the present disclosure to be implemented in a sequence except those illustrated herein. Moreover, the terms "include", "comprise" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent.

It should be noted that the terms such as "first" and "second" are used herein only for the purpose of description and are not intended to indicate or imply relative importance, or implicitly indicate the number of the indicated technical features. Therefore, features defined by "first" and "second" may explicitly or implicitly include at least one of the features. Further, the technical solutions of the various embodiments may be combined with each other on the basis that the combination is implementable by those of ordinary skill in the art. In case a combination of the technical solutions is contradictory or infeasible, such a combination is deemed inexistent and not falling within the protection scope of the present disclosure.

Referring to FIG. 1 to FIG. 5, an embodiment of the present disclosure provides a speaker 100. The speaker 100 includes a frame 10, a magnetic circuit unit 20 fixed to the frame 10, and a vibration unit 30 for vibrating and producing sound. The magnetic circuit unit 20 drives the vibration unit 30 to vibrate and produce sound.

Figure 1:
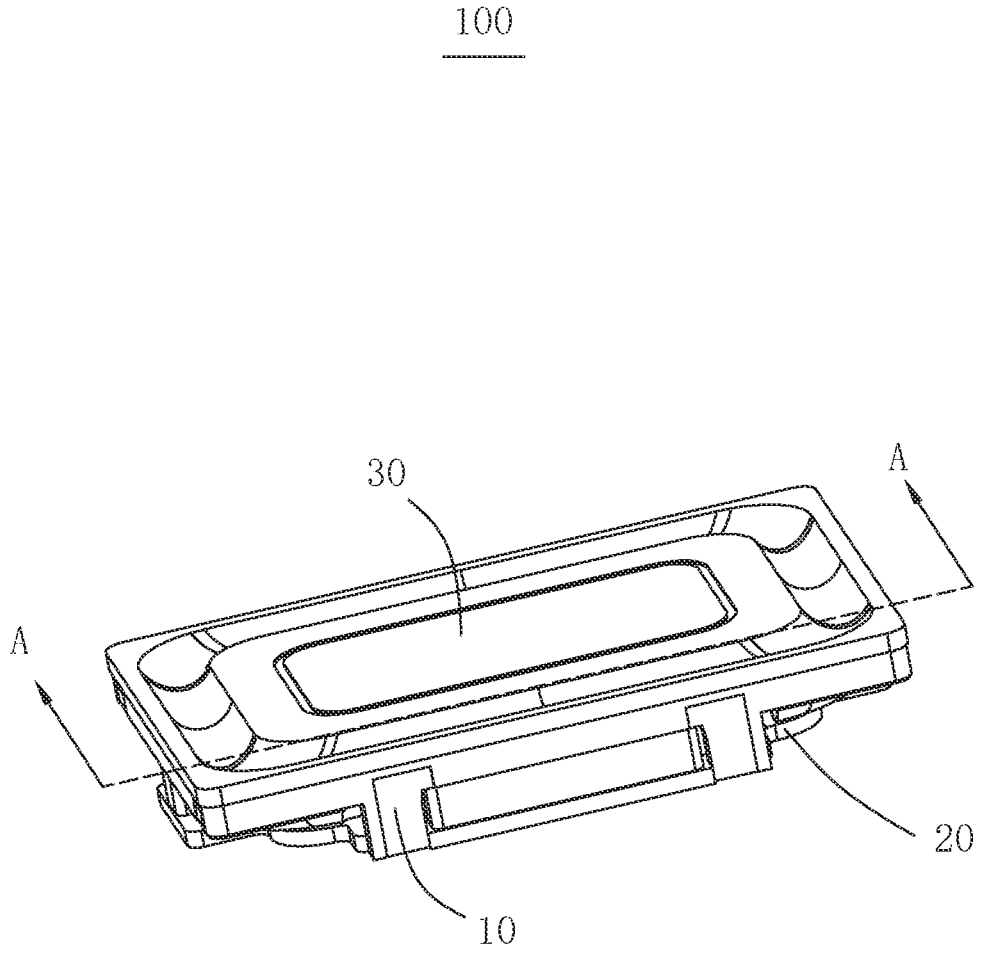
FIG. 1 is a three-dimensional view of a speaker according to an embodiment of the present disclosure.
Figure 2:
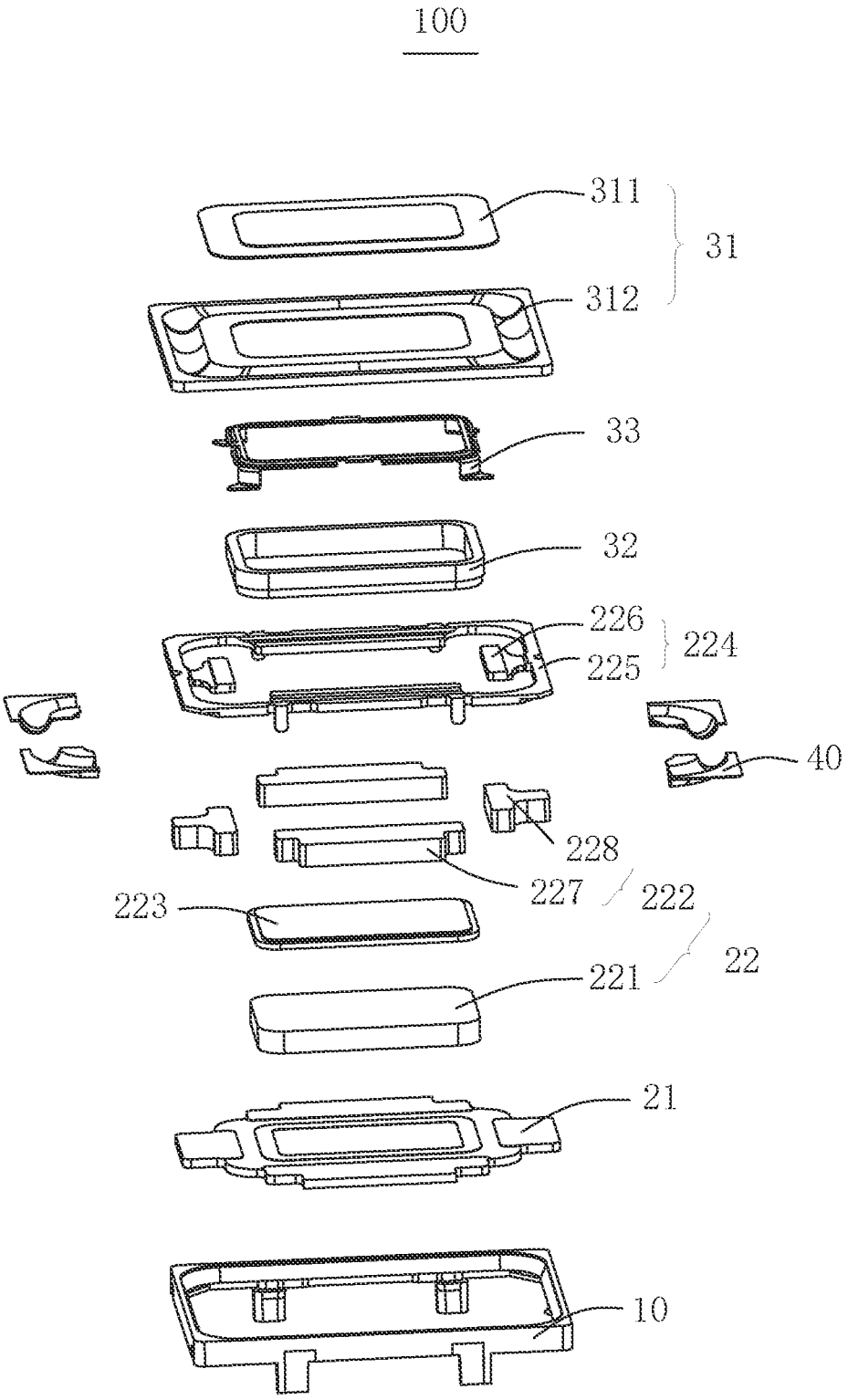
FIG. 2 is an exploded view of a speaker according to an embodiment of the present disclosure.

As shown in FIG. 2, the magnetic circuit unit 20 includes a flat yoke 21 fixed to the frame 10, and a magnet 22 fixed to a central position of the yoke 21. In this embodiment, the magnet 22 includes a main magnet 221 located at a central position, and auxiliary magnets 222 spaced apart at a peripheral side of the main magnet 221. The main magnet 221 is spaced apart from the auxiliary magnets 222 to form a magnetic gap.

Figure 3:
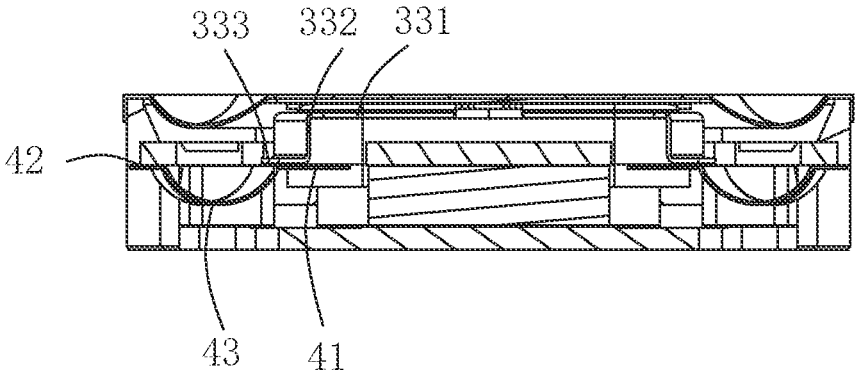
FIG. 3 is a sectional view of the speaker taken along line A-A shown in FIG. 1.
Figure 4:
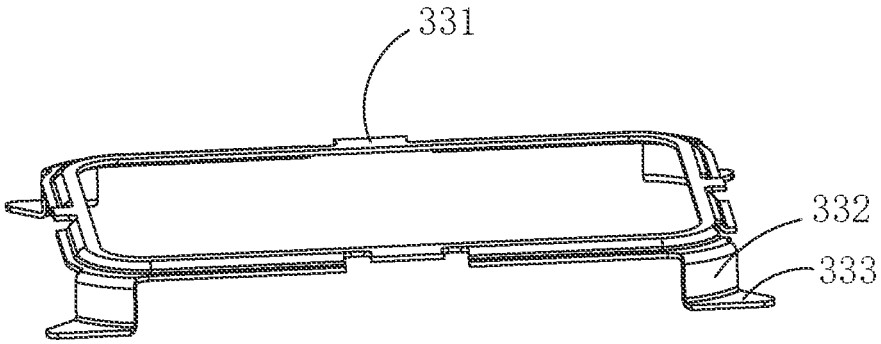
FIG. 4 is a three-dimensional view of a holder of a speaker according to an embodiment of the present disclosure.
Figure 5:
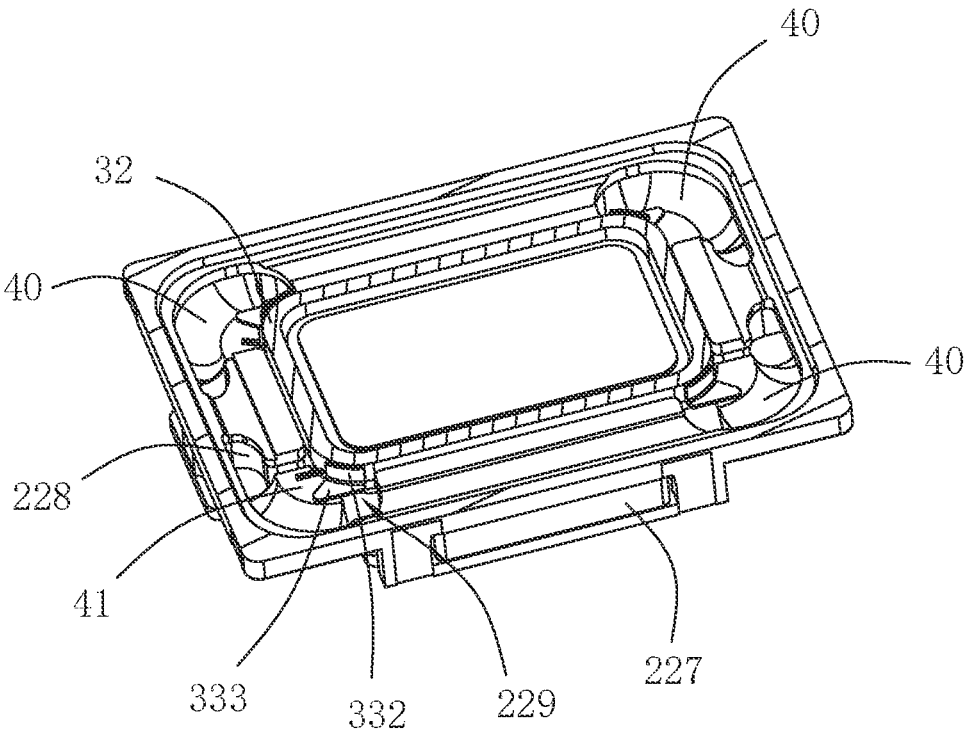
FIG. 5 is a partial view of a speaker according to an embodiment of the present disclosure.

As shown in FIG. 2 to FIG. 4, the vibration unit 30 includes a diaphragm 31 fixed to the frame 10, and a voice coil 32 fixed to the diaphragm 31. The voice coil 32 is inserted into the magnetic gap to drive the diaphragm 31 to vibrate and produce sound. In this embodiment, the diaphragm 31 includes a dome 311 located at a central position, and a suspension 312 surrounding the dome 311. The dome 311 is fixed to an inner edge of the suspension 312, and an outer edge of the suspension 312 is fixed to the frame 10.

In this implementation, as shown in FIG. 2, the magnetic circuit unit 20 further includes a main pole plate 223 fixed to a surface of the main magnet 221 facing the diaphragm 31, and a pole plate 224 fixed to the auxiliary magnets 222. Specifically, the pole plate 224 includes a ring-shaped pole plate body 225 and auxiliary pole plates 226 extending from the pole plate body 225. The auxiliary pole plates 226 are fixed to surfaces of the auxiliary magnets 222 facing the diaphragm 31. The main pole plate 223 and the auxiliary pole plates 226 allow the magnetic induction lines emitted from the main magnet 221 and the auxiliary magnets 222 more concentrated, thereby reducing the magnetic force loss and improving the driving force of the magnetic circuit unit 20. The pole plate body 225 is fixed to the frame 10 so as to integrally fix the magnetic circuit unit 20 to the frame 10 to form a fixed structure. Specifically, four auxiliary magnets 222 are provided. Correspondingly, the pole plate body 225 has a racetrack shape. Four auxiliary pole plates 226 are formed by extending respectively from two long edges and two short edges of the pole plate body 225.

As shown in FIG. 2 to FIG. 4, the speaker 100 further includes a conductive lower diaphragm 40 fixed to the voice coil 32 and opposite to and spaced apart from the diaphragm 31. The conductive lower diaphragm 40 includes an inner connecting portion 41 fixed to and connected to the voice coil 32, an outer connecting portion 42 fixed to and connected to the frame 10, and an intermediate portion 43 connecting the inner connecting portion 41 and the outer connecting portion 42. The voice coil 32 is electrically connected to the inner connecting portion 41, and the outer connecting portion 42 is electrically connected to an external circuit, thereby achieving electrical connection between the voice coil 32 and the external circuit.

In an embodiment, the voice coil 32 has a racetrack shape. Correspondingly, four conductive lower diaphragms 40 are provided. The four conductive lower diaphragms 40 are respectively provided at position of four corners of the voice coil 32, that is, the four inner connecting portions 41 are respectively connected to the corners of the voice coil 32. It is understandable that only two of the four conductive lower diaphragms 40 need to be connected to lead wires of the voice coil 32. The two conductive lower diaphragms 40 can be arbitrarily selected to be electrically connected to the voice coil 32, depending on a winding situation of the voice coil 32. In this embodiment, two conductive lower diaphragms 40 located at positions of two corners at a short edge of the voice coil 32 are electrically connected to the voice coil 32.

As shown in FIG. 2 to FIG. 4, the vibration unit 30 further includes a holder 33 for supporting the voice coil 32 inside the magnetic gap 223. The holder 33 includes a ring-shaped body portion 331 sandwiched between the voice coil 32 and the diaphragm 31, a first extension portion 332 extending along an outer side surface of the voice coil 32 after bending from the body portion 331 in a direction away from the diaphragm 31, and a second extension portion 333 extending from an end of the first extension portions 332 away from the body portion 331 in a direction away from an outer side surface of the voice coil 32. An inner connecting portion 41 of the conductive lower diaphragm 40 is fixed to the second extension portion 333. It should be understood that the outer side surface of the voice coil 32 is a surface parallel to a vibrating direction and away from the main magnet 221. The first extension portion 332 is spaced apart from the outer side surface of the voice coil 32. The second extension portion 333 is fixed to a surface of the inner connecting portion 41 facing the diaphragm 31, and the inner connecting portion 41 is opposite to and spaced apart from the outer side surface of the voice coil 32. The first extension portions 332 and the second extension portions 333 are spaced apart from the voice coil 32 to effectively avoid noise caused by collision with the voice coil 32 during vibration. That is, the conductive lower diaphragm 40 is fixed to and connected to the voice coil 32 through the holder 33 to support the holder 33 and the voice coil 32.

In an embodiment, the auxiliary magnets 222 include first auxiliary magnets 227 arranged along long edges of the voice coil 32 and second auxiliary magnets 228 arranged along short edges of the voice coil 32. The first auxiliary magnets 227 are spaced apart from the second auxiliary magnets 228 to form accommodating gaps 229, and the conductive lower diaphragms 40 are accommodated in the accommodating gaps 229.

Compared with the related art, the speaker 100 provided by the embodiments of the present disclosure includes a conductive lower diaphragm 40 fixed to the voice coil 32 and opposite to and spaced apart from the diaphragm 31. The conductive lower diaphragm 40 includes an inner connecting portion 41 fixed to and connected to the voice coil 32, an outer connecting portion 42 fixed to and connected to the frame 10, and an intermediate portion 43 connecting the inner connecting portion 41 and the outer connecting portion 42. The voice coil 32 is electrically connected to the inner connecting portion 41, and the outer connecting portion 42 is electrically connected to an external circuit, thereby achieving electrical connection between the voice coil 32 and the external circuit. Such a structure ensures the electrical connection between the voice coil 32 and the external circuit, and eliminates the need for a flexible printed circuit (FPC) to save an internal space of the speaker and reduce the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame;

a vibration unit fixed to the frame; and a magnetic circuit unit comprising a magnetic gap, wherein the magnetic circuit unit comprises a yoke fixed to the frame, and a magnet fixed to a side of the yoke facing the vibration unit; the vibration unit comprises a diaphragm fixed to the frame, and a voice coil fixed to the diaphragm; the voice coil is inserted into the magnetic gap to drive the diaphragm to vibrate and produce sound; the speaker further comprises at least one conductive lower diaphragm fixed to the voice coil and opposite to and spaced apart from the diaphragm; each of the at least one conductive lower diaphragm comprises an inner connecting portion fixed to and connected to the voice coil, an outer connecting portion fixed to and connected to the frame, and an intermediate portion configured to connect the inner connecting portion and the outer connecting portion; the voice coil is electrically connected to the inner connecting portion; and the outer connecting portion is electrically connected to an external circuit.

2. The speaker as described in claim 1, wherein the voice coil has a racetrack shape; the at least one conductive lower diaphragm comprises four conductive lower diaphragms, the four conductive lower diaphragms comprise four inner connecting portions; and the four inner connecting portions of the four conductive lower diaphragms are connected to corners of the voice coil, respectively.

3. The speaker as described in claim 1, wherein the vibration unit further comprises a holder for supporting the voice coil inside the magnetic gap; the holder comprises a body portion having a ring shape and sandwiched between the voice coil and the diaphragm, a first extension portion extending along an outer side surface of the voice coil after bending from the body portion in a direction away from the diaphragm, and a second extension portion extending from an end of the first extension portion away from the body portion in a direction away from the outer side surface of the voice coil; and the inner connecting portion is fixed to the second extension portion.

4. The speaker as described in claim 3, wherein the first extension portion is spaced apart from the outer side surface of the voice coil.

5. The speaker as described in claim 3, wherein the second extension portion is fixed to a surface of the inner connecting portion facing the diaphragm; and the inner connecting portion is opposite to and spaced apart from the voice coil.

6. The speaker as described in claim 1, wherein the magnet comprises a main magnet located at a central position, and auxiliary magnets that are spaced apart from each other at a peripheral side of the main magnet and spaced apart from the main magnet to form the magnetic gap; the auxiliary magnets comprise first auxiliary magnets arranged along long edges of the voice coil and second auxiliary magnets arranged along short edges of the voice coil; the first auxiliary magnets are spaced apart from the second auxiliary magnets to form accommodating gaps; and the at least one conductive lower diaphragm is accommodated in the accommodating gaps.

7. The speaker as described in claim 1, wherein the magnet comprises a main magnet located at a central position, and auxiliary magnets that are spaced apart from each other at a peripheral side of the main magnet and spaced apart from the main magnet to form the magnetic gap; and the magnetic circuit unit further comprises a main pole plate fixed to a surface of the main magnet facing the diaphragm, and an auxiliary pole plate fixed to a surface of each of the auxiliary magnets facing the diaphragm.

* * * * *